US011332343B2

(12) United States Patent
Martin et al.

(10) Patent No.: US 11,332,343 B2
(45) Date of Patent: May 17, 2022

(54) TENSION MEMBER FOR ELEVATOR SYSTEM BELT

(71) Applicant: Otis Elevator Company, Farmington, CT (US)

(72) Inventors: Kyle B. Martin, Avon, CT (US); Chen Qian Zhao, Newark, DE (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 406 days.

(21) Appl. No.: 15/958,634

(22) Filed: Apr. 20, 2018

(65) Prior Publication Data

US 2018/0305178 A1 Oct. 25, 2018

Related U.S. Application Data

(60) Provisional application No. 62/487,822, filed on Apr. 20, 2017.

(51) Int. Cl.
*B66B 7/06* (2006.01)
*B66B 9/00* (2006.01)
(Continued)

(52) U.S. Cl.
CPC ..... *B66B 7/062* (2013.01); *B66B 9/00* (2013.01); *D07B 1/005* (2013.01); *D07B 1/04* (2013.01);
(Continued)

(58) Field of Classification Search
CPC ..... B66B 7/062; B66B 9/00; D07B 1/005; D07B 1/04; D07B 1/162; D07B 1/22;
(Continued)

(56) References Cited

U.S. PATENT DOCUMENTS 6,314,711 B1 * 11/2001 De Angelis ..... B66B 7/06 57/210
6,318,504 B1 * 11/2001 De Angelis ..... D07B 1/167 187/254
(Continued)

FOREIGN PATENT DOCUMENTS

CN 102797183 A 11/2012
CN 102797184 A 11/2012
(Continued)

OTHER PUBLICATIONS

European Search Report Issued In EP Application No. 18168616.3, dated Sep. 3, 2018, 8 Pages.

*Primary Examiner* — Michael A Riegelman
(74) *Attorney, Agent, or Firm* — Cantor Colburn LLP

(57) ABSTRACT

A belt for an elevator system includes a plurality of tension members arranged along a belt width and extending longitudinally along a length of the belt. Each tension member includes a core member formed from a plurality of load carrying fibers, and a plurality of overwrap members surrounding the core member. A jacket material at least partially encapsulates the plurality of tension members. An elevator system includes a hoistway, an elevator car positioned in the hoistway and movable therein, and a belt operably connected to the elevator car to suspend and/or drive the elevator car along the hoistway. The belt includes a plurality of tension members arranged along a belt width and extending longitudinally along a length of the belt. Each tension member includes a core member formed from a plurality of load carrying fibers, and a plurality of overwrap members surrounding the core member.

6 Claims, 3 Drawing Sheets

(51) Int. Cl.
*D07B 1/00* (2006.01)
*D07B 1/04* (2006.01)
*D07B 1/16* (2006.01)
*D07B 1/22* (2006.01)

(52) U.S. Cl.
CPC ..... *D07B 1/162* (2013.01); *D07B 1/22* (2013.01); *D07B 1/24* (2021.01); *D07B 2201/102* (2013.01); *D07B 2201/1092* (2013.01); *D07B 2201/2014* (2013.01); *D07B 2201/2066* (2013.01); *D07B 2201/2086* (2013.01); *D07B 2401/207* (2013.01); *D07B 2501/2007* (2013.01)

(58) Field of Classification Search
CPC ..... D07B 2201/102; D07B 2201/1092; D07B 2201/2014; D07B 2201/2066; D07B 2201/2086; D07B 2401/207; D07B 2501/2007
See application file for complete search history.

(56) References Cited

U.S. PATENT DOCUMENTS 7,191,585 B2 * 3/2007 Vanderbeken ..... B66B 7/06 57/223
7,828,121 B2 * 11/2010 Parrini ..... D07B 1/02 187/251
7,862,891 B2 * 1/2011 Hanna ..... D07B 1/167 428/378
9,050,768 B2 * 6/2015 Urbani ..... B66B 7/062
9,126,805 B2 9/2015 Pelto-Huikko et al.
2004/0065529 A1 * 4/2004 Cediel ..... B65G 15/32 198/847
2011/0000746 A1 * 1/2011 Pelto-Huikko ..... D07B 5/10 187/254
2011/0259677 A1 * 10/2011 Dudde ..... B66B 7/062 187/411
2012/0297746 A1 * 11/2012 Chou ..... D07B 1/02 57/230
2013/0042939 A1 * 2/2013 Wesson ..... D03D 13/004 139/11
2013/0048432 A1 * 2/2013 Alasentie ..... B66B 7/068 187/251
2013/0171463 A1 * 7/2013 Chang ..... B66B 7/06 428/549
2013/0206516 A1 * 8/2013 Pelto-Huikko ..... D07B 1/145 187/254
2014/0027211 A1 * 1/2014 Wesson ..... B66B 7/06 187/414
2014/0305744 A1 * 10/2014 Kere ..... B66B 7/06 187/254
2014/0345978 A1 * 11/2014 Alasentie ..... D07B 1/02 187/254
2015/0113936 A1 * 4/2015 Amils ..... D07B 3/00 57/216
2015/0191331 A1 * 7/2015 Orelup ..... B29D 29/00 428/76
2015/0307321 A1 * 10/2015 Breite ..... B66B 7/062 187/254
2016/0207739 A1 * 7/2016 Pelto-Huikko ..... B66B 7/085
2017/0101293 A1 * 4/2017 Eastman ..... D07B 5/006
2017/0217729 A1 * 8/2017 Lehtinen ..... B66B 7/062
2018/0155870 A1 * 6/2018 Eastman ..... B66B 7/068
2018/0282125 A1 * 10/2018 Zhao ..... B66B 9/00
2018/0305178 A1 * 10/2018 Martin ..... D07B 1/22
2018/0305180 A1 * 10/2018 Guilani ..... F16G 5/14
2018/0305181 A1 * 10/2018 Zhao ..... D07B 1/165
2018/0305182 A1 * 10/2018 Zhao ..... B66B 7/062
2018/0339882 A1 * 11/2018 Zhao ..... H01B 7/0009
2019/0062114 A1 * 2/2019 Zhao ..... B66B 7/062
2019/0062115 A1 * 2/2019 Zhao ..... D07B 5/04
2019/0062116 A1 * 2/2019 Zhao ..... B66B 7/062
2019/0144241 A1 * 5/2019 Guilani ..... D07B 1/162 187/251
2019/0168999 A1 * 6/2019 Guilani ..... D07B 1/22
2020/0048043 A1 * 2/2020 Zhao ..... D07B 1/04

FOREIGN PATENT DOCUMENTS

CN 202545683 U 11/2012
CN 202809359 U 3/2013
CN 202898863 U 4/2013
CN 102635003 B 2/2015
CN 102635004 B 2/2015
CN 204370224 U 6/2015
EP 3330209 A1 6/2018
WO 2012120144 A2 9/2012
WO 2015134025 A1 9/2015

* cited by examiner

-- Prior Art --

TENSION MEMBER FOR ELEVATOR SYSTEM BELT

CROSS-REFERENCE TO RELATED APPLICATIONS

This application claims the benefit of 62/487,822, filed Apr. 20, 2017, which is incorporated herein by reference in its entirety.

BACKGROUND

Embodiments disclosed herein relate to elevator systems, and more particularly to load bearing members to suspend and/or drive elevator cars of an elevator system.

Elevator systems are useful for carrying passengers, cargo, or both, between various levels in a building. Some elevators are traction based and utilize load bearing members such as belts for supporting the elevator car and achieving the desired movement and positioning of the elevator car.

Where a belt is used as a load bearing member, a plurality of tension elements, or cords, are embedded in a common jacket. The jacket retains the cords in desired positions and provide a frictional load path. In an exemplary traction elevator system, a machine drives a traction sheave with which the belts interact to drive the elevator car along a hoistway. Belts typically utilize tension members formed from steel elements, but alternatively may utilize tension members formed from synthetic fibers or other materials, such as carbon fiber composites.

In a carbon fiber composite tension member, the members are typically very stiff in bending, and at cross-sectional areas of tension members desired to provide a selected tensile performance, the tension member may be damaged under bending.

BRIEF DESCRIPTION

In one embodiment, a belt for an elevator system includes a plurality of tension members arranged along a belt width and extending longitudinally along a length of the belt. Each tension member includes a core member formed from a plurality of load carrying fibers, and a plurality of overwrap members surrounding the core member. A jacket material at least partially encapsulates the plurality of tension members.

Additionally or alternatively, in this or other embodiments the plurality of load carrying fibers are positioned in a matrix material.

Additionally or alternatively, in this or other embodiments the load carrying fibers are one or more of carbon, glass, aramid, nylon, and polymer fibers.

Additionally or alternatively, in this or other embodiments the matrix material is a polyurethane, polyester, vinylester, or epoxy material.

Additionally or alternatively, in this or other embodiments the plurality of overwrap members are synthetic fibers.

Additionally or alternatively, in this or other embodiments the synthetic fibers are one or more of Vectran™ or Dyneema® or Zylon® fibers.

Additionally or alternatively, in this or other embodiments the plurality of overwrap members are metallic wires.

Additionally or alternatively, in this or other embodiments the plurality of overwrap fibers are wrapped or braided around the core member. Additionally or alternatively, in this or other embodiments the jacket material is selected from the group consisting of polyurethanes, polyesters, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber or combinations thereof.

In another embodiment, an elevator system includes a hoistway, an elevator car positioned in the hoistway and movable therein, and a belt operably connected to the elevator car to suspend and/or drive the elevator car along the hoistway. The belt includes a plurality of tension members arranged along a belt width and extending longitudinally along a length of the belt. Each tension member includes a core member formed from a plurality of load carrying fibers, and a plurality of overwrap members surrounding the core member. A jacket material at least partially encapsulates the plurality of tension members.

Additionally or alternatively, in this or other embodiments the plurality of load carrying fibers are positioned in a matrix material.

Additionally or alternatively, in this or other embodiments the load carrying fibers are one or more of carbon, glass, aramid, nylon, and polymer fibers.

Additionally or alternatively, in this or other embodiments the matrix material is a polyurethane, vinylester, polyester, or epoxy material.

Additionally or alternatively, in this or other embodiments the plurality of overwrap members are synthetic fibers.

Additionally or alternatively, in this or other embodiments the plurality of overwrap members are metallic wires.

Additionally or alternatively, in this or other embodiments the plurality of overwrap members are configured to suspend the elevator car in the event of failure of the core member.

Additionally or alternatively, in this or other embodiments the jacket material is selected from the group consisting of polyurethanes, polyesters, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber, or combinations thereof.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
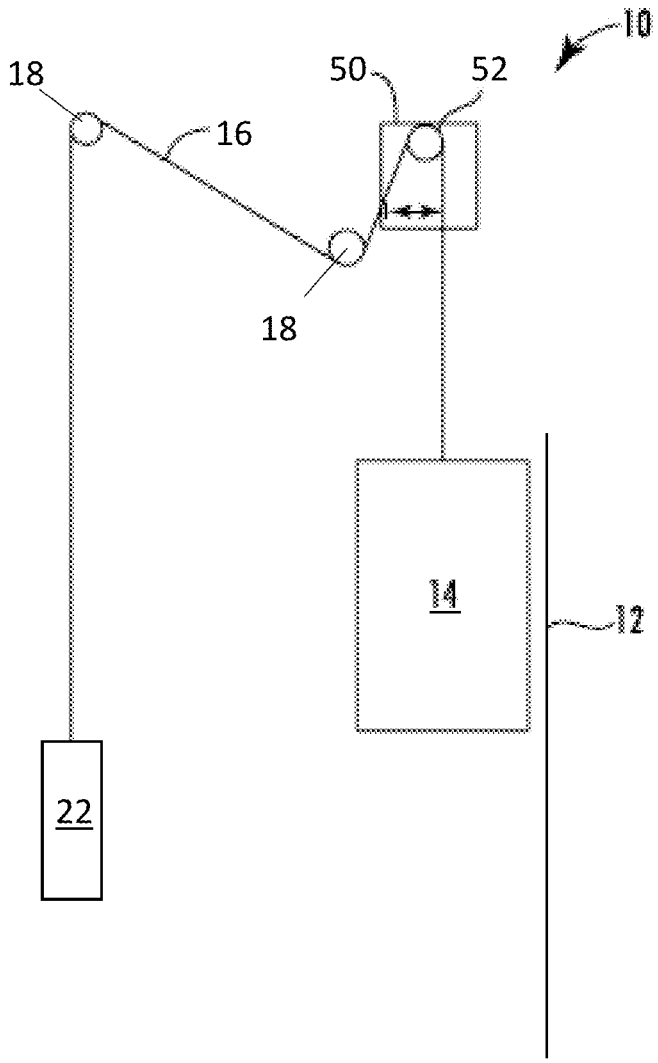
FIG. 1 is a schematic illustration of an embodiment of an elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended or supported in a hoistway 12 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 52. The traction sheave 52 is driven by a machine 50. Movement of drive sheave by the machine 50 drives, moves and/or propels (through traction) the one or more belts 16 that are routed around the traction sheave 52. At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 14. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 14 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 14.

Figure 2:
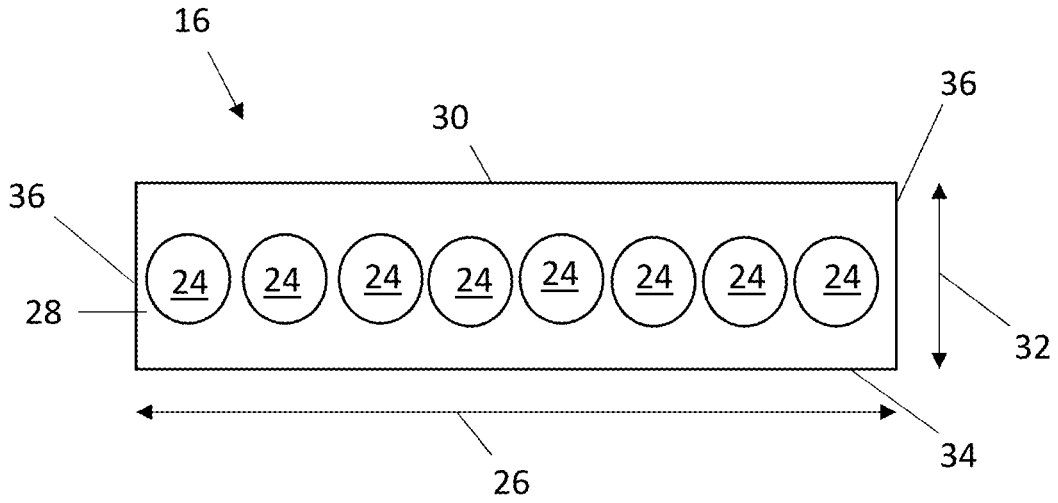
FIG. 2 is a schematic cross-sectional view of an embodiment of an elevator system belt.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket material 28 to restrain movement of the tension members 24 in the belt 16 and to protect the tension members 24. The jacket material 28 defines a traction side 30 configured to interact with a corresponding surface of the traction sheave 52. Exemplary materials for the jacket material 28 include the elastomers of thermoplastic and thermosetting polyurethanes, polyamide, thermoplastic polyester elastomers, and rubber, for example. In some embodiments, the jacket material 28 is selected from the group consisting of polyurethanes, polyesters, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber or combinations thereof. Other materials may be used to form the jacket material 28 if they are adequate to meet the required functions of the belt 16. For example, a primary function of the jacket material 28 is to provide a sufficient coefficient of friction between the belt 16 and the traction sheave 52 to produce a desired amount of traction therebetween. The jacket material 28 should also transmit the traction loads to the tension members 24. In addition, the jacket material 28 should be wear resistant and protect the tension members 24 from impact damage, exposure to environmental factors, such as chemicals, for example.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While eight tension members 24 are illustrated in the embodiment of FIG. 2, other embodiments may include other numbers of tension members 24, for example, 6, 10 or 12 tension members 24. Further, while the tension members 24 of the embodiment of FIG. 2 are substantially identical, in other embodiments, the tension members 24 may differ from one another.

Figure 3:
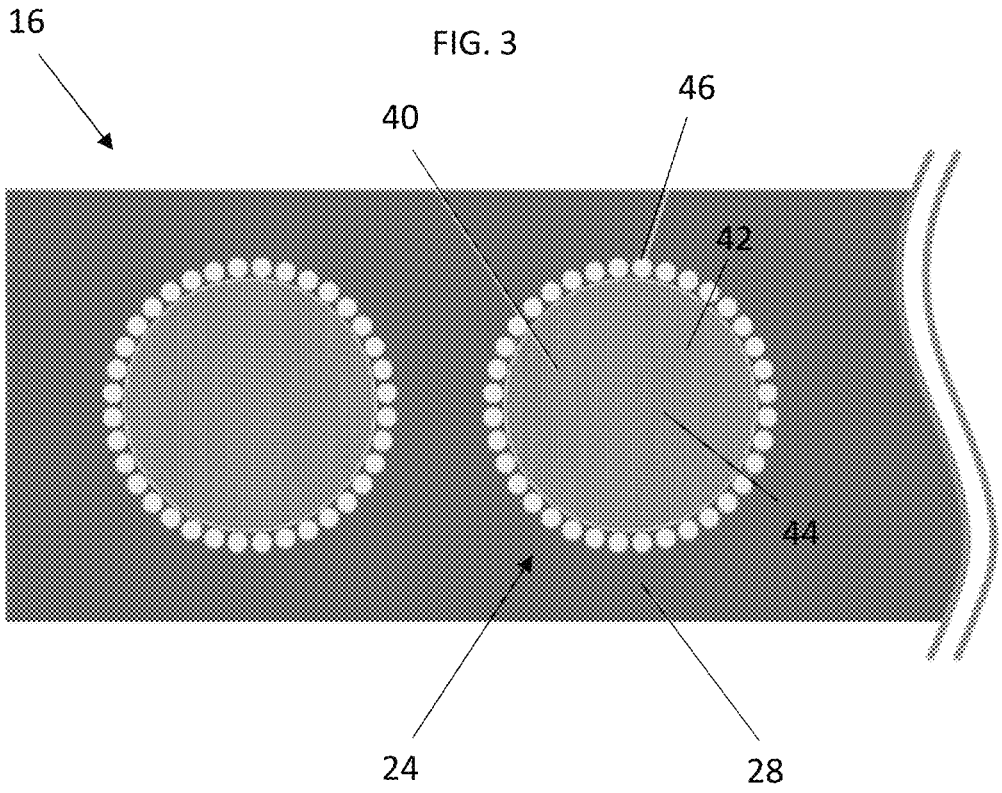
FIG. 3 is a cross-sectional view of an embodiment of a tension member for an elevator belt.

As shown in FIG. 3, the tension members 24 each include a core member 40 formed from synthetic fibers or from a composite construction, such as a plurality of load-carrying fibers 42, which in some embodiments are disposed in a matrix material 44. In other embodiments, a matrix material is not used, with the tension member 24 formed from a so-called "dry fiber" construction.

Exemplary load carrying fibers 42 include, but are not limited to, carbon, glass, aramid, nylon, and polymer fibers, for example. Each of the load carrying fibers 42 may be substantially identical or may vary. In addition, the matrix material 44 may be formed from any suitable material, such as polyurethane, polyester, vinylester, and epoxy for example. The materials of the load carrying fibers 42 and the matrix material 44 are selected to achieve a desired stiffness and strength of the tension member 24.

The core member 40 may be formed as thin layers, in some embodiments by a pultrusion process. In a standard pultrusion process, the load carrying fibers 42 are impregnated with the matrix material 44 and are pulled through a heated die and additional curing heaters where the matrix material 44 undergoes cross linking. A person having ordinary skill in the art will understand that controlled movement and support of the pulled load carrying fibers 42 may be used to form a desired linear or curved profile of the core member 40. In an exemplary embodiment, the core member 40 has a cross-sectional thickness of about 0.5 millimeters to about 4 millimeters. In another embodiment, the core member 40 has a cross-sectional thickness of 1 millimeter. Further, in some embodiments the core member 40 has a circular cross-section, while in other embodiments the core member 40 may have other cross-sectional shapes, such as rectangular or oval. In other embodiments, the core member 40 may be a single or multi-material, dry fiber core configuration.

The tension member 24 further includes a plurality of overwrap elements 46 disposed at an outer perimeter of the core member 40. The overwrap elements 46 extend in a generally lengthwise direction along the tension member 24, and in some embodiments are wrapped or braided around the core member 40. In some embodiments, the overwrap elements 46 are a plurality of synthetic fibers such as Vectran™ or Dyneema® or Zylon®. One skilled in the art will readily appreciate that the listed materials are merely exemplary and that other materials may be utilized. The overwrap elements 46 are configured with a reduced bending stiffness relative to the core member 40, but with similar tensile strength compared to the load carrying fibers 42. The result is a tension member 24 with decreased bending stiffness when compared to an all-core tension member having a comparable tensile strength.

Figure 4:
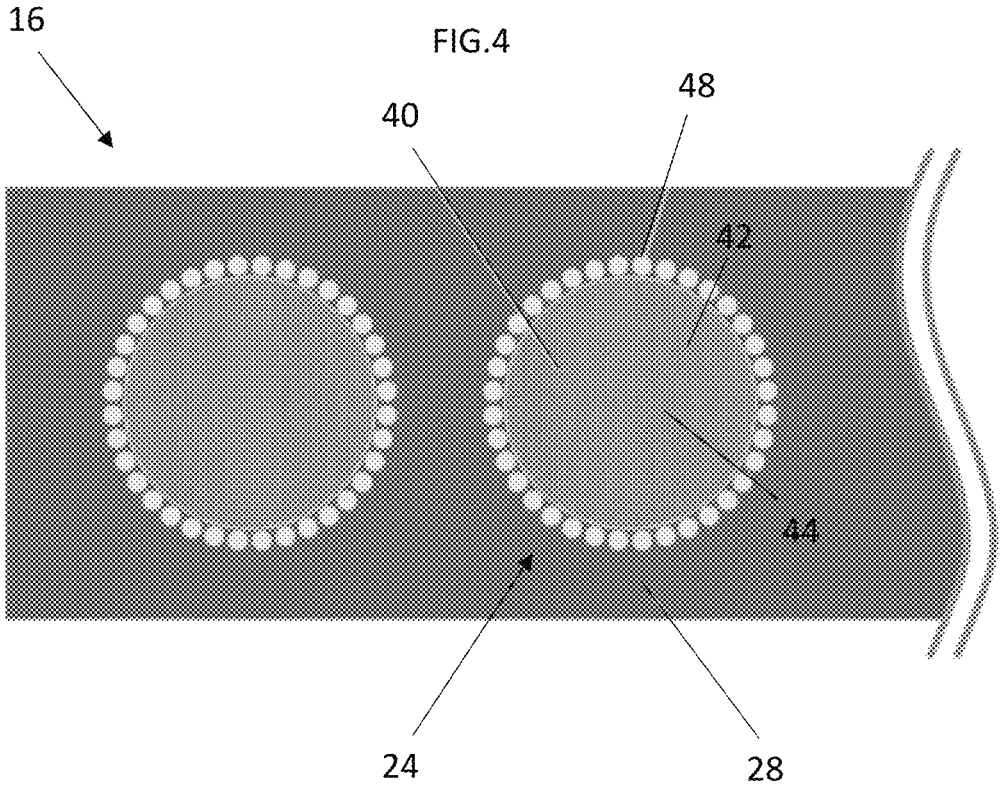
FIG. 4 is another cross-sectional view of an embodiment of a tension member for an elevator belt.

In an alternative embodiment illustrated in FIG. 4, the overwrap elements are a plurality of metallic wires 48, such as steel wires, or strands formed from a plurality of metallic wires 48. In some embodiments, the metallic wires 48 are sufficient to support the elevator car 14 in the hoistway 12 in the event of damage to or failure of the core member 40 due to, for example, breakage or a thermal event.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A belt for an elevator system, comprising:

a plurality of tension members arranged along a belt width and extending longitudinally along a length of the belt, each tension member including:

a core member formed from a plurality of load carrying fibers, the core member formed from load carrying fibers of two or more materials, absent a matrix material;

a plurality of overwrap members surrounding the core member; and a jacket material at least partially encapsulating the plurality of tension members;

wherein the plurality of overwrap members are metallic;

wherein the plurality of overwrap members are configured to support an elevator car of the elevator system in the case of failure of the core member of the belt.

2. The belt of claim 1, wherein the plurality of load carrying fibers are disposed in a matrix material.

3. The belt of claim 2, wherein the load carrying fibers are one or more of carbon, glass, aramid, nylon, and polymer fibers.

4. The belt of claim 2, wherein the matrix material is a polyurethane, polyester, vinylester, or epoxy material.

5. The belt of claim 1, wherein the plurality of overwrap members are wrapped or braided around the core member.

6. The belt of claim 1, wherein the jacket material is selected from the group consisting of polyurethanes, polyesters, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber or combinations thereof.

* * * * *